US006010034A

United States Patent [19]

Walthers

[11] Patent Number: 6,010,034

[45] Date of Patent: Jan. 4, 2000

[54] COMBINATION DRINK AND SPRAY SPORTS BOTTLE

[75] Inventor: Richard W. Walthers, Glendale, Calif.

[73] Assignee: Premium Designs, LLC, Parma, Ohio

[21] Appl. No.: 09/264,262

[22] Filed: Mar. 8, 1999

[51] Int. Cl.[7] ..... B67D 5/40; A47G 21/18; B05B 15/00

[52] U.S. Cl. ..... 222/135; 222/129; 222/331; 222/383.1; 222/192; 239/33; 239/289

[58] Field of Search ..... 222/129, 135, 222/192, 330, 331, 383.1; 239/33, 289, 333

[56] References Cited

U.S. PATENT DOCUMENTS

| | | | |
|---|---|---|---|
| 4,030,664 | 6/1977 | Tisbo et al. | 239/289 |
| 4,614,284 | 9/1986 | Miles | 222/331 |
| 4,618,076 | 10/1986 | Silvenis | 222/331 |
| 4,815,635 | 3/1989 | Porter | 222/192 |
| 4,932,563 | 6/1990 | Diamond et al. | 222/129 |
| 5,542,581 | 8/1996 | Habora et al. | 222/331 |
| 5,595,325 | 1/1997 | Leres | 222/135 |
| 5,788,125 | 8/1998 | Steiner et al. | 222/331 |
| 5,799,873 | 9/1998 | Lau | 239/33 |

*Primary Examiner*—Kevin Shaver
*Assistant Examiner*—Keats Quinalty
*Attorney, Agent, or Firm*—David A. Burge

[57] ABSTRACT

A combination drink and spray sports bottle defines a nested arrangement of inner and outer containers that provides a nested set of segregated inner and outer chambers for containing separate quantities of liquid, with a drinking straw being provided for withdrawing drinking liquid from the outer chamber, and with a manually operated spray device being provided for withdrawing spraying liquid from the inner chamber. The outer container has an upstanding body that defines a relatively large neck opening near its upper end, through which the upstanding body of the inner container is insertable. A large cap closes the large neck opening of outer container. A central opening and an off-center opening are formed through the large cap. The straw extends through the off-center opening of the large cap and has a lower end region for depending into a quantity of drinking liquid carried in the outer chamber. A relatively small neck opening of the inner container communicates with the spray device through the central opening of the large cap, and the spray device has a suction tube for depending into a quantity of spraying liquid carried in the inner chamber. The large cap not only closes the outer container but also serves to position and support the inner container and its spray device, to position the drinking straw, and to provide a vent for relieving pressure within the outer chamber.

20 Claims, 4 Drawing Sheets

COMBINATION DRINK AND SPRAY SPORTS BOTTLE

BACKGROUND OF THE INVENTION

1. Field of the Invention

The present invention relates to a combination drink and spray sports bottle for separately carrying and separately dispensing a quantity of drinking liquid by use of a drinking straw, and a quantity of spraying liquid by use of a manually operated sprayer. More particularly, the present invention relates to a combination drink and spray sports bottle for separately carrying a drinking liquid and a spraying liquid in a nested arrangement of outer and inner chambers defined by a nested pair of outer and inner containers, with a drinking straw being provided for accessing the drinking liquid through an off-center hole formed a relatively large cap that closes a relatively large neck opening of the outer container, with a spray device being provided for accessing the spraying liquid through a relatively small neck opening of the inner container, and with at least one of the spray device and a neck of the inner container being connected to the large cap of the outer container near a central opening that is defined by the large cap through which liquid from the inner container is drawn and discharged in a selected direction as a mist when the spray device is operated.

2. Prior Art

Drink-carrying bottles having relatively large diameter necks that are closed by caps are known for carrying drinking liquids such as ice water, iced tea, cold soft drinks and the like. Bottles of this type having straws that extend through holes formed in their caps often are carried by sports fans who attend sporting events in outdoor stadiums and the like, and by players for conveniently providing something to drink while watching or participating in sporting events.

Spray bottles having relatively small necks that are closed by caps that carry manually operable sprayer assemblies also are known. Indeed, tens of thousands of liquid products are sold in small-necked bottles that are provided with conventional depress-to-operate sprayer cap assemblies that are available from hundreds of commercial sources world wide. Some sports enthusiasts have used containers of this type to provide a supply of water that can be sprayed onto one's face, arms, legs and other exposed skin surfaces while viewing outdoor sporting events during hot days of summer and fall, or while participating in sporting events, to cool the skin and otherwise provide a refreshing effect.

When sports fans and players have wanted both a spray bottle and a drink bottle with them while attending a sporting event, this has, until now, necessitated that both types of containers be separately carried—an arrangement that has proved to be inconvenient and often has led to spillage. While carrying and maintaining in an upright attitude a single liquid-filled container are activities that seem to pose no serious problem, transporting and keeping track of two liquid-filled containers and maintaining both in upright attitudes often have proved to be too bothersome a task for sports enthusiasts who want to devote their concentration, instead, to the game.

While dual-chamber containers and various types of nested container arrangements have been proposed for other purposes, the unique needs of sports fans and players for a simple and inexpensive dual-chamber "sports bottle" (that will provide separate supplies of drinking and spraying liquids) are not adequately addressed by the prior art. Dual-chamber containers that have odd or complex appearances have received poor acceptance by sports enthusiasts who don't want to deal with devices they are likely to mis-handle when their attention is elsewhere.

SUMMARY OF THE INVENTION

The present invention addresses the foregoing and other needs and drawbacks of prior proposals by providing a dual-function sports bottle that has one liquid carrying container nested within another for carrying a drinking liquid in a relatively large outer chamber that can be accessed in the traditional way by using a straw that extends through an off-center opening formed in the cap of the outer container, and for carrying a spraying liquid in a relatively small inner chamber that also can be accessed in the traditional way by using a manually operated spray assembly that communicates with the inner container through a central opening of the cap that closes the outer container.

A significant advantage offered by sports bottle containers that embody the preferred practice of the present invention is simplicity of appearance. Except for a small, upstanding knob-like sprayer located unobtrusively at the center of the cap that closes the outer container, these dual-function units have the appearance of simple single-drink containers of the type that sports enthusiasts are quite accustomed to carrying. Simplicity of appearance also can be enhanced by forming the outer of the nested containers from a frosted, translucent plastics material, or from opaque plastic, so that the inner of the containers is not visible through the outer of the containers. This simple, straightforward appearance also is complemented by the easy-to-clean and easy-to-assemble character of the minimal number of parts that comprise the unit, which further enhances the very acceptable impression that this new product presents to purchasers.

A further advantage of the simplicity of sports bottle containers that embody the preferred practice of the present invention resides in the low cost at which sprayer assemblies and drinking straws can be commercially purchased, and the low cost at which plastic containers and caps can be manufactured—which brings this interesting new product into the price range where it can be used as a "give-away" that carries advertising and trademarks. Indeed, the sizable upstanding outer surface of the outside of the sports bottle provides quite a nice space on which advertising or the logos of sports teams can be imprinted, which often serves to render the resulting product even more acceptable to the sports enthusiast.

From a structural point of view, significant economy is achieved by sports bottles that embody the preferred practice of the invention by assigning a plurality of functions to the cap which closes the large neck of the outer of the nested containers. In preferred practice, the outer container cap not only functions to close the large neck opening of the outer container but also serves 1) to support and position the inner container at an optimum centered location within the outer container, 2) to support and position the drinking straw to extend between spaced side walls of the inner and outer containers and through an off-center opening defined by the outer container cap, and 3) to provide a vent opening to prevent the pressure inside the outer container from rising above or below ambient atmospheric pressure (which could result if the outer container were not vented, for example due to the expansion and contraction of fluid within the outer container due to temperature changes, changes in volume of container contents due to phase changes such as the melting of ice, or the release of gases from carbonated sodas or other drinking liquids).

While there are a number of ways in which the sprayer unit and the inner container may be communicated through a central opening that is formed through the cap of the outer container, and while some of these alternate approaches are disclosed later herein, the approach that is utilized in the preferred practice of the invention is one that minimizes the cost of the outer container cap by eliminating a need for its central opening to be provided with internal or external threads or other structure for establishing secure connections with the sprayer unit and the inner container. The preferred approach utilizes a simple, centrally located hole formed through the outer container cap, through which the neck of the inner container extends, and onto which a conventional depress-to-operate sprayer cap assembly is threaded. A bottom shoulder of the sprayer cap assembly engages the top side of the outer container cap to connect the sprayer cap assembly and the inner container to the outer container cap. Stated in another way, the needed connections are established simply by screwing the commercially purchased sprayer cap assembly onto the neck of the inner container after the neck of the inner container has been inserted through a central hole defined by the outer container cap.

While there are a number of ways in which a vent opening can be defined by the outer container cap to ensure that the pressure within the outer container remains equal to that of the surrounding atmosphere, the preferred approach is to utilize the looseness of either the off-center hole through which the drinking straw extends, or the looseness of the hole through which the neck of the inner container extends, to provide such a vent. By taking this simple approach, and by utilizing a simple commercially available sprayer cap assembly to engage the top side of the outer container cap to connect the sprayer cap assembly and the inner container to the outer cap, the combination drink and spray sports bottle can be assembled with a very small number of parts, all of which are easy to disassemble, clean and reassemble, namely: an outer container, an inner container, a straw, an outer container cap, and the commercially purchased sprayer cap assembly (which requires no disassembly to clean). If desired, a simple cover can be added for each of the sprayer and the drinking straw—but some sports enthusiasts will remove and discard these optional covers.

The container-within-a-container approach taken by the present invention provides the sports enthusiast with a sports bottle that is capable of performing dual functions—i.e., a single unit that will serve the same purposes previously served by utilizing two separate containers in providing access through a drinking straw and a manually operable sprayer to separate liquids carried in separate reservoirs, but with the ease and simplicity of manipulating what is envisioned as comprising a nothing more than a "single container." Stated in another way, the functions of two containers are offered in an attractive unit that has the appearance and ready acceptability of a simple single-chamber soft drink container—a simple and straightforward unit that tends to be well received by the sports enthusiast who is quite accustomed to managing a "single drink container" such as a tall container of bottled water, soft drink or beer that has a straw projecting from its cap.

In view of the foregoing, it will be understood that one object of the present invention is to provide a combination drink and spray sports bottle that includes an upstanding inner container having a generally, cylindrical body defining an inner chamber and an opening near an upper end region of the inner container that is accessed by a manually operable sprayer for dispensing in a chosen direction a spray consisting of liquid drawn from within the inner container; an upstanding outer container having a generally cylindrical body defining an outer chamber of substantially larger capacity than the inner chamber and a relatively large neck opening near an upper end region of the outer container, and having a drinking straw that extends upwardly from a bottom region of the outer container through the neck opening of the outer container; and, a relatively large cap for closing the relatively large neck opening of the outer container, for engaging the inner container to position the generally cylindrical body of the inner container to depend substantially centrally into the outer chamber and to position the sprayer means to dispense said spray at a location above the cap, and for defining an off-center opening through which the straw extends when the straw depends into the outer chamber alongside the body of the inner container.

Likewise, another object is to provide a combination drink and spray sports bottle that includes an inner container nested within an outer container for cooperatively defining a relatively small spraying liquid chamber nested within and segregated from a relatively larger drinking liquid chamber, with the inner container being configured to be removable from the drinking liquid chamber through a neck opening defined by the outer container near an upper end region of the outer container; a manually operable sprayer communicating with the spraying liquid chamber for discharging a spray of liquid therefrom when manually operated; a drinking straw for depending alongside the inner container into the drinking liquid chamber, and for projecting through the neck opening for being engaged by one's lips so that liquid can be drawn out of the drinking liquid chamber through the drinking straw; and, an outer container cap for closing the neck opening of the outer container, for supporting the manually operable sprayer to discharge spray at a a location above the cap, for supporting the inner container to depend into the drinking liquid chamber, and for defining an off-center opening through which the drinking straw extends as it projects through the neck opening.

BRIEF DESCRIPTION OF THE DRAWINGS

These and other objects and features, and a fuller understanding of the present invention may be had by referring to the following description and claims, taken in conjunction with the accompanying drawings, wherein:

DESCRIPTION OF THE PREFERRED EMBODIMENT

Figure 1:
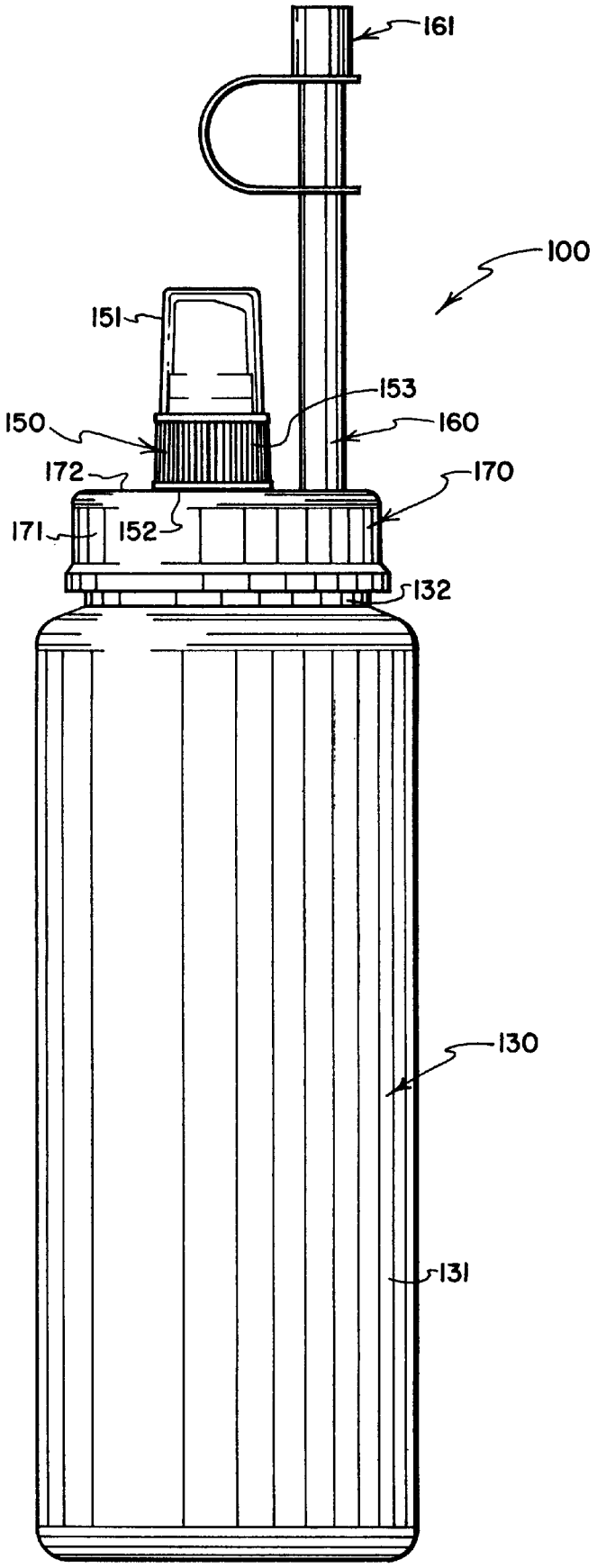
FIG. 1 is side elevational view of a combination drink and spray sports bottle, with a sprayer and a drinking straw of the bottle separately covered.
Figure 2:
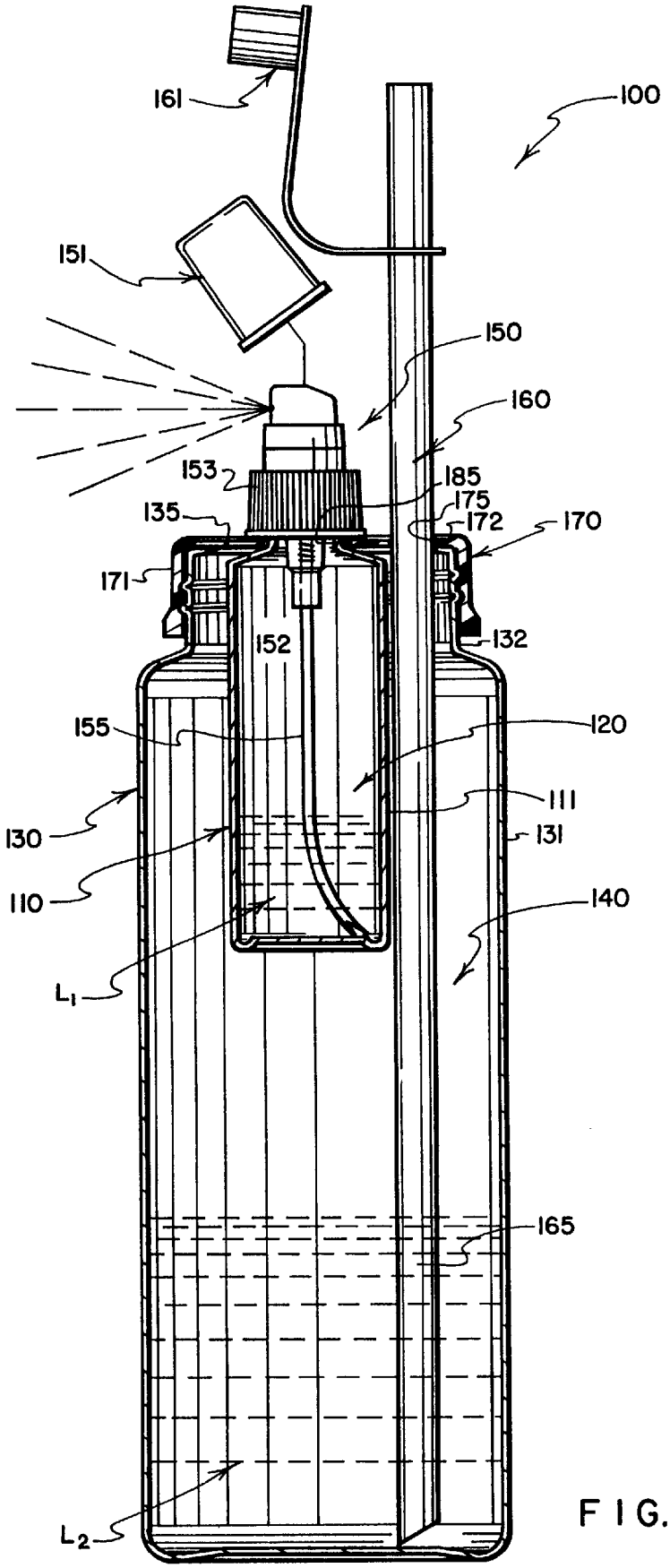
FIG. 2 is a side elevational view similar to FIG. 1 but with the sprayer and the drinking straw uncovered, with portions of the nested inner and outer containers of the bottle broken away leaving remaining portions shown in cross-section, and with separate quantities of liquid shown in the nested containers.
Figure 3:
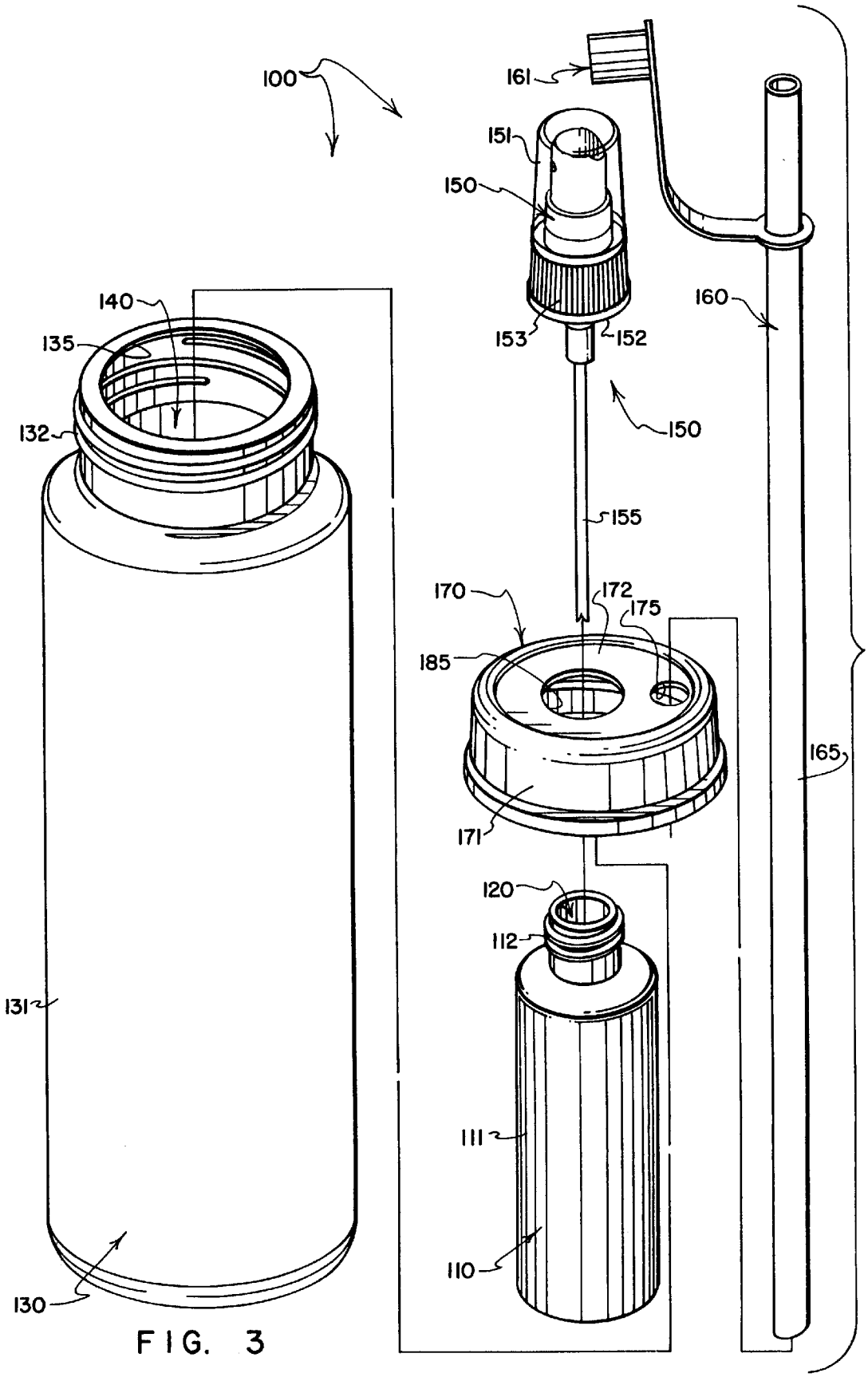
FIG. 3 is an exploded perspective view showing components of the combined drink and spray sports bottle; and, FIGS. 4, 5 and 6 are cross-sectional views that illustrate three alternate but less preferred ways in which a neck of an inner container can be connected to a manually operable sprayer in the vicinity of a central opening that is formed through the relatively large cap of an outer container.

Referring to FIGS. 1–3, a combination drink and spray sports bottle embodying features of the preferred practice of the present invention is indicated generally by the numeral 100. The external appearance of the bottle 100 is dominated by an upstanding, generally cylindrical sidewall 131 of an outer container 130, by a relatively large diameter outer cap 170 that is threaded onto an upstanding neck 132 of the outer container 130, by an off-center drinking straw 160 that extends upwardly from the outer cap 170, and by a small spray device or push-to-operate sprayer 150 that extends a short distance up from substantially the center of the outer cap 170. In FIG. 1, a removable cover 161 is shown in place covering the upper end of the drinking straw 160, and a removable cover 151 is shown in place covering most (if not all) of the visible portions of the sprayer 150. If it is desired that the sports bottle 100 have an even simpler exterior appearance, the sprayer cover 151, which is depicted as being transparent, can be made from opaque material to thereby hide upper portions of the sprayer 150 from view.

Referring to FIGS. 2 and 3 wherein features that are internal to the sports bottle 100 can be viewed, the sports bottle 100 includes a relatively small inner container 110 for defining a relatively small inner chamber 120, and the relatively large outer container 130 for defining a relatively large outer chamber 140. When the components of the bottle 100 are duly assembled (as depicted in FIG. 2), the inner container 110 nests within the outer container 130, whereby the inner chamber 120 nests within the outer chamber 140.

While the inner chamber 120 is described herein as being of substantially smaller size (i.e., as being of substantially smaller liquid-carrying capacity) than the outer chamber 140, those who are skilled in the art will readily understand that the actual liquid-carrying capacity of the outer chamber 140 is significantly diminished by the presence within the outer chamber 140 of the inner container 110. Thus, while the outer container 130 needs to be significantly larger than the inner container 110 (to provide some reasonable amount of liquid-carrying capacity after the inner container 110 has been inserted into the outer chamber 140), the actual liquid-carrying capacities of the inner and outer chambers 120, 140 can be equal, or can differ, as desired, by modifying the relative volumes of the inner and outer containers 110, 130. In preferred practice, the actual liquid-carrying capacity of the inner chamber 120 is within the range of about one-fifth to about three-quarters of the actual liquid-carrying capacity of the outer chamber 140 (measured with the components of the sports bottle 100 assembled, as depicted in FIG. 2). A smaller quantity of spraying liquid and a larger quantity of drinking liquid often is what sports enthusiasts favor. However, the relationship of the actual liquid-carrying capacities of the containers 110, 130 is a matter of choice that can be varied, as desired, without departing from the spirit of the invention. And, as those who are skilled in the art will readily appreciate, if ice is carried in either of the chambers 120, 140, its presence will assist in cooling the liquids that are carried in both of the chambers 120, 140.

Although the containers 110, 130 are described and depicted herein as being of generally cylindrical upstanding form, the configurations of the containers 110, 130 is a matter of design choice. The use of generally cylindrical containers is preferred because it gives the sports bottle 100 a readily acceptable appearance and shape, and because generally cylindrical container shapes tend to work well if one also desires to make use of generally cylindrical, externally threaded container necks (which are relatively inexpensive to form and can be used quite reliably to provide releasable connections with other structures such as container caps). Moreover, generally cylindrical containers tend to efficiently provide good fluid-carrying capacity at relatively low manufacturing cost. While opaque, single-thickness materials are preferred for use in providing the simple, straightforward containers 110, 130 of the sports bottle 100, transparent or plural-layer materials may be used, if desired, to enhance visibility, to provide added insulating capability, or for other purposes.

Referring to FIGS. 2 and 3, the outer container cap 170 has a depending, generally cylindrical side wall 171 that is internally threaded and perimetrically surrounds a generally flat top wall 172 which has a substantially uniform thickness across its width. The sidewall 171 is threaded onto the externally threaded neck 132 of the outer container 130 to close a relatively large neck opening 135 (see FIG. 3) of the outer container 130. A centrally located hole 185 is formed through the top wall 172 to relatively loosely receive an externally threaded, upstanding neck 112 of the inner container 110 therein, and an off-center hole 175 to relatively loosely receive the drinking straw 160. In preferred practice, the looseness with which the hole 185 receives the container neck 112, and/or the looseness with which the hole 175 receives the straw 160, is utilized to provide a simple means of venting the outer chamber 140 to atmosphere—to ensure that the pressure within the outer chamber 140 is maintained in balance with ambient atmospheric pressure.

Referring still to FIGS. 2 and 3, the manually operable push-to-spray device or sprayer 150 (which can comprise any of a wide variety of commercially purchased cap-mounted sprayer pumps that are available worldwide from a variety of sources) has a suction tube 155 that extends from an internally threaded base portion 153 of the sprayer 150. The base portion 153 defines a bottom shoulder 152 which engages the top wall 172 of the outer container cap 170. When the internally threaded base 153 of the sprayer 150 is threaded onto the neck 112 of the inner container 110, the engagement of the shoulder 152 with the top wall 172 provides a means for supporting both the inner container 110 and the sprayer 150 on the outer container cap 170. Thus, the outer container cap 170 not only serves to support the inner container 110 and the sprayer 150, but also serves to centrally position the inner container 110 and the sprayer 150 due to the central location of the opening 185 through which the neck 112 of the inner container 110 extends.

In similar fashion, the location of the off-center hole 175 serves to position the drinking straw 160 to extend between the upstanding sidewalls 111, 131 of the inner and outer containers 110, 130; and, the fact that the straw 160 extends through the off-center hole 175 provides a connection between the straw 160 and the outer container cap 170 that helps to hold the straw 160 in its proper position.

Referring to FIG. 2, the suction tube 155 of the sprayer 150 extends through the centrally located hole 185 formed through the outer container cap 130 and into the inner chamber 120 for depending into a quantity of spraying liquid $L_1$ that is carried within the inner chamber 120. The drinking straw 160 extends through the off-center hole 175 formed through the outer container cap 130 and into the outer chamber 140 for depending into a quantity of liquid $L_2$ that is carried within the outer chamber 140.

In preferred practice, the centrally located opening 185 comprises nothing more than a simple hole of sufficiently large size to permit an upwardly extending neck 111 of the inner container 110 to extend therethrough, but of sufficiently small size to prevent the base 153 of the sprayer 150 from passing therethrough—whereby the downwardly facing shoulder 152 defined by the base 153 of the cap-type sprayer 150 is caused to seat against the top wall 172 of the outer container cap 170 (due to the weight of the inner container 110, the sprayer 150, and such liquid $L_1$ as may be carried within the inner container 110). However, other arrangements for providing connections among an outer container cap, an inner container and a sprayer also may be used, as will readily be understood by those who are skilled in the art, with examples being provided in FIGS. 4, 5 and 6.

Figure 4:
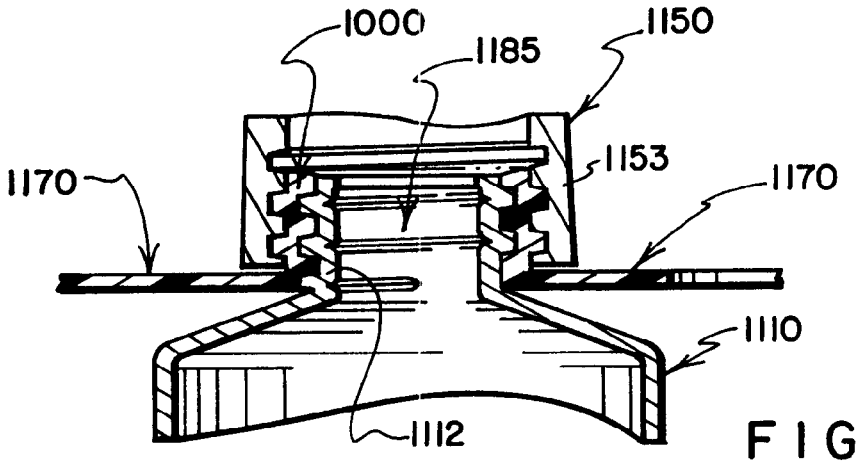
Figure 5:
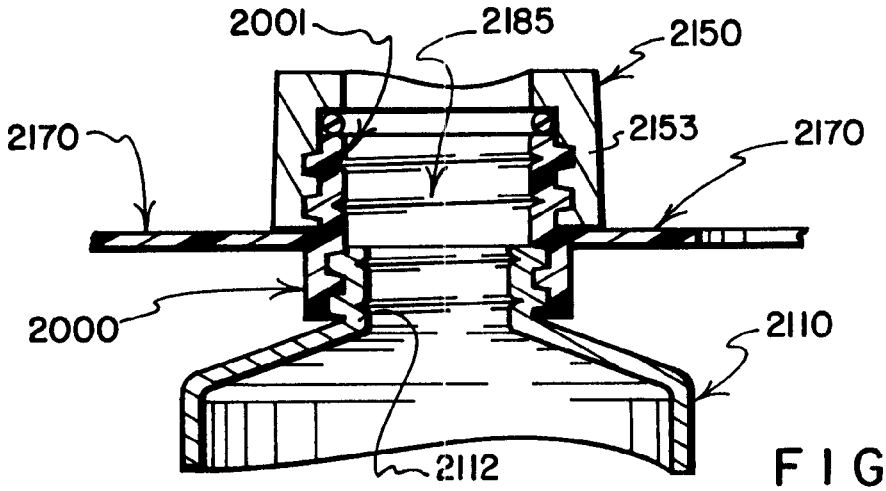
Figure 6:
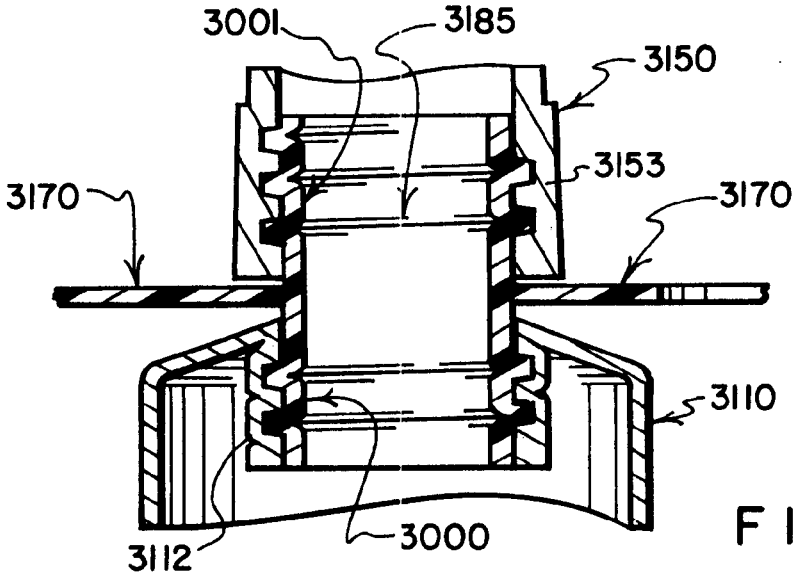

In FIGS. 4, 5 and 6: 1) upper portions of inner containers that correspond to the inner container 110 shown in FIGS. 2 and 3 are indicated by the numerals 1110, 2110, 3110; 2) base portions of sprayers that correspond to the sprayer 150 shown in FIGS. 1—3 are indicated by the numerals 1150, 2150, 3150; 3) central portions of outer container caps that correspond to the outer container cap 170 shown in FIGS. 1–3 are indicated by the numerals 1170, 2170, 3170; and, 4) central openings that correspond to the central opening 185 shown in FIGS. 2 and 3 are indicated by the numerals 1185, 2185, 3185, respectively.

In FIG. 4, a central opening 1185 is defined by an externally and internally threaded upstanding neck 1000 of the outer container cap 1170—and, the externally threaded neck 1112 of the inner container 1110 is threaded into the neck 1000, while the internally threaded base portion 1153 of the sprayer 1150 is threaded onto the neck 1000.

In FIG. 5, a central opening 2185 is defined by an internally threaded downwardly extending neck formation 2000, and by an externally threaded upwardly extending neck formation 2001 of the outer container cap 2170—and, the externally treaded neck 2112 of the inner container 2110 is threaded into the neck formation 2000, while the internally threaded base portion 2153 of the sprayer 2150 is threaded onto the neck formation 2001.

In FIG. 6, a central opening 3185 is defined by a downwardly and upwardly extending neck formations 3000, 3001 of the outer container cap 3170, both of which are externally threaded—and, internally threaded portions 3112, 3153 of the inner container 3120 and of the base 3153 of the sprayer 3150 are threaded thereon, respectively.

A disadvantage of the connection arrangements of FIGS. 4–6 is that the upwardly and downwardly extending neck formations that are required to define the central openings 1185, 2185, 3185 cause the manufacture of the outer container caps 1170, 2170, 3170 to be significantly more complex and costly than is required when a simple hole 185 is utilized, as is depicted in FIGS. 2 and 3.

While threaded connections are utilized to connect various components in the depicted preferred embodiment, many other forms of connections, such as snap together connections, twist-to-lock connections and the like also can be utilized.

One source for the manually operable push-to-spray device or sprayer 150 is Kerr Group, Inc., Plastics Product Division, Pittsburgh, Pa. 15264 which sells an appropriate assembly under the designation PB01204102CYLN-20/410. Another source is Emson, Inc., Hartford, Conn., which sells an appropriate assembly under the designation TS04W204.50-20/410-W-FM-FTS-4-½.

The manner in which the sports bottle 100 is used is quite straightforward. To fill the inner container 110 with a spraying liquid such as water, the outer container cap 170 is unscrewed and lifted away from the outer container 130 to thereby raise the inner container 110 out of the chamber 140, and the sprayer base 153 is unscrewed from the inner container neck 112 to provide access to the inner chamber 110. While the outer container cap 130 is removed, the outer chamber 140 is supplied with a quantity of drinking liquid such as water or one of the many beverages that are sold to provide nourishment, energy and/or refreshment. And, the assembled relationship of the various components of the sports bottle, as depicted in FIG. 2, is then restored.

Cleaning the components is likewise straightforward, involving disassembly and washing with soap and water—except for the sprayer assembly, which ordinarily is not disassembled, but rather is soaked in a soap and water solution, with a quantity of the soap and water solution being pumped through the sprayer—whereafter all of the components are rinsed and dried.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty exist in the invention.

What is claimed is:

1. A combination drink and spray bottle, comprising:

a) an inner container having an upstanding body that surrounds an inner chamber and defines near an upper end region of the body of the inner container an inner mouth opening that provides access to the inner chamber;

b) an outer container of having an upstanding body that surrounds an outer chamber of substantially larger size than the inner chamber, and defines near an upper end region of the body of the outer container an outer mouth opening that provides access to the outer chamber and is of sufficient size to permit the body of the inner container to be inserted into the outer chamber to a position wherein the outer mouth opening is relatively near to and extends generally around the inner mouth opening;

c) manually operable sprayer means for defining a suction tube insertable into a quantity of liquid carried in the inner chamber, for pumping such liquid from the inner chamber, and for spraying liquid pumped from the inner chamber in a selected direction in response to being manually operated;

d) drinking straw means for defining a lower end region that is insertable into a quantity of liquid carried in the outer chamber, and an upper end region that can be engaged by one's lips for drawing liquid from the outer chamber into one's mouth for drinking;

e) cap means:

i) for closing the outer mouth opening and for defining a third opening through which the straw means may extend to permit the upper end region of the straw means to reside outside the outer chamber while the lower end region of the straw means depends into the outer chamber; and, iii) for defining a fourth opening through which the sprayer means may draw liquid from the inner container for spraying in said selected direction; and, f) means for connecting the cap means, the inner container and the sprayer means within the vicinity of the fourth opening for supporting the inner container and the sprayer means within the vicinity of the fourth opening.

2. The combination drink and spray bottle of claim 1 wherein the cap means has a top wall configured to overlie the outer mouth opening, to define the fourth opening at a substantially centered location of the top wall, and to define the third opening at an off-center location of the top wall spaced from the fourth opening.

3. The combination drink and spray bottle of claim 2 wherein the means for connecting the cap means, the inner container and the sprayer means includes an externally threaded neck of the inner container that extends upwardly through the fourth opening of the cap means, an an internally threaded base of the sprayer means that is threaded onto the externally threaded neck of the inner container and that defines a shoulder that engages the top wall at a location near the fourth opening.

4. The combination drink and spray bottle of claim 1 wherein the means for connecting the cap means, the inner container and the sprayer means includes at least one threaded connection that couples two of: a) the cap means; b) the inner container; and, c) the sprayer means.

5. The combination drink and spray bottle of claim 1 wherein the means for connecting the cap means, the inner container and the sprayer means includes a first threaded connection that connects the cap means to the inner container, and a second threaded connection that connects the cap means to the sprayer means.

6. The combination drink and spray bottle of claim 1 additionally including a removable cover that is installable on, for the purpose of protectively covering upper portions of, at least one of the drinking straw means and the manually operable sprayer means.

7. A combination drink and spray bottle, comprising:

a) relatively small capacity inner container means for defining an inner chamber for containing spraying liquid therein, having an inner upper end region configured to define an inner access opening that communicates with the inner chamber;

b) manually operable sprayer means for providing suction tube means for extending through the inner access opening into a quantity of spraying liquid contained in the inner chamber for withdrawing and spraying a quantity of the spraying liquid in response to operation of the sprayer means;

c) relatively large capacity outer container means for defining an outer chamber substantially larger than the inner chamber for containing drinking liquid therein, having an outer upper end region configured to define an outer access opening that communicates with the outer chamber and is of sufficient size to permit the small capacity container means to be inserted into the outer chamber to position the inner chamber substantially centrally within the outer chamber, with the inner upper end region located near the outer upper end region;

d) means for closing the outer access opening and for being connected to at least a selected one of the manually operable sprayer means and the inner container means for supporting a) the inner container means substantially centrally within the outer chamber with the inner upper end region located near the outer upper end region, and b) the sprayer means with the suction tube means extending into the inner chamber for withdrawing and spraying a quantity of the spraying liquid in response to operation of the sprayer means; and, e) straw means for defining for extending through a drinking straw opening defined by the means for closing the outer access opening for permitting a quantity of drinking liquid contained within the outer chamber to be withdrawn from the outer chamber by sucking on the straw.

8. The combination drink and spray bottle of claim 7 wherein the inner container means and the outer container means are configured such that, when the relatively small capacity inner container is supported substantially centrally within the outer chamber with the inner upper end region located near the outer upper end region, the quantity of spraying liquid that can be carried within the inner chamber is about one-fifth to about three-fourths of the amount of drinking liquid that can be carried within the outer chamber.

9. The combination drink and spray bottle of claim 7 wherein the means for closing the outer access opening includes an outer cap that is removably connected to an upstanding neck of the outer container means, the outer cap has a top wall configured to overlie the outer access opening, and the drinking straw opening is formed through the top wall at a location spaced from a center region of the top wall.

10. The combination drink and spray bottle of claim 9 wherein the means for closing the outer access opening and for being connected to at least a selected one of the manually operable sprayer means and the inner container means includes at least one threaded connection that couples two of: a) the outer cap; b) the inner container means; and, c) the sprayer means.

11. A combination drink and spray container, comprising:

a) a relatively large outer container that extends about a relatively large outer container chamber and has a generally cylindrical upstanding neck that defines a relatively large diameter outer neck opening that provides access to the outer container chamber;

b) a relatively small inner container that extends about a relatively small inner container chamber and has a generally cylindrical upstanding neck that defines a relatively small diameter inner neck opening that provides access to the inner container chamber;

c) cap means for engaging the upstanding neck of the outer container for closing the relatively large diameter outer neck opening, and for defining first and second spaced holes that align with the relatively large diameter outer neck opening;

d) drinking straw means extending through the first of the spaced holes for permitting one to drink liquid from the outer container chamber;

e) manually operable sprayer means connected to the upstanding neck of the relatively small inner container for permitting liquid from the inner container chamber to be sprayed in response to operation of the sprayer means; and, f) at least a selected one of the sprayer means and the neck of the relatively small inner container having portions that extend through the second of the spaced holes.

12. The combination drink and spray container of claim 11 wherein the cap means has a top wall configured to overlie the outer neck opening, to define the second of the spaced holes at a substantially centered location of the top wall, and to define the first of the spaced holes at an off-center location of the top wall.

13. The combination drink and spray container of claim 11 wherein the neck of the inner container is externally threaded and extends through the second of the spaced holes, and the sprayer means has a base that is internally threaded for connection to the externally threaded neck of the inner container.

14. The combination drink and spray container of claim 11 additionally including a removable cover that is installable on, for the purpose of protectively covering upper portions of, at least one of the drinking straw means and the manually operable sprayer means.

15. A combination drink and spray sports bottle comprising:

a) inner container means nested within outer container means for cooperatively defining a relatively small spraying liquid chamber nested within and segregated from a relatively larger drinking liquid chamber, with the inner container means being configured to be removable from the drinking liquid chamber through a neck opening defined by the outer container means near an upper end region of the outer container means;

b) manually operable sprayer means communicating with the spraying liquid chamber for discharging a spray of liquid therefrom when manually operated;

c) drinking straw means for depending alongside the inner container means into the drinking liquid chamber, and for projecting through the neck opening for being engaged by one's lips so that liquid can be drawn out of the drinking liquid chamber through the drinking straw means; and, d) cap means for closing the neck opening of the outer container means, for supporting the manually operable sprayer means to discharge spray at a location above the cap means, for supporting the inner container means to depend into the drinking liquid chamber, and for defining a straw-receiving opening through which the drinking straw means extends as it projects through the neck opening.

16. The combination drink and spray sports bottle of claim 15 wherein:

a) the cap means has a top wall configured to overlie the outer mouth opening, to define a neck-receiving opening at a substantially centered location of the top wall, and to define the straw-receiving opening at an off-center location of the top wall spaced from the neck-receiving opening; and, b) the inner container means has an upwardly extending neck means for extending through the neck-receiving opening and for being connected to the manually operable sprayer means at a location above the top wall of the cap means.

17. The combination drink and spray sports bottle of claim 16 additionally including at least one threaded connection that couples two of: a) the cap means; b) the inner container means; and, c) the sprayer means.

18. A combination drink and spray sports bottle, comprising:

a) an upstanding inner container having a generally cylindrical body defining an inner chamber and an opening near an upper end region of the inner container that is capped by manually operable sprayer means for dispensing in a chosen direction a spray consisting of liquid drawn from within the inner container;

b) an upstanding outer container having a generally cylindrical body defining an outer chamber of substantially larger capacity than the inner chamber and a relatively large neck opening near an upper end region of the outer container, and having a drinking straw extending upwardly from a bottom region of the outer container through the neck opening of the outer container; and, c) cap means for closing the relatively large neck opening of the outer container, for engaging the inner container to position the generally cylindrical body of the inner container to depend into the outer chamber and to position the sprayer means to dispense said spray at a location above the cap means, and for defining a straw-receiving opening through which the straw extends when the straw depends into the outer chamber alongside the body of the inner container.

19. The combination drink and spray sports bottle of claim 18 additionally including threaded connection means for connecting the manually operable sprayer means to an upstanding neck defined by the upstanding inner container.

20. The combination drink and spray sports bottle of claim 19 wherein the cap means has a top wall configured to overlie the relatively large neck opening of the outer container, to define at a substantially centered location of the top wall a neck-receiving opening through which the upstanding neck of the inner container extends, and to define the straw-receiving opening at an off-center location of the top wall spaced from the neck-receiving opening.

* * * * *